United States Patent [19]

Bone et al.

[11] Patent Number: 4,897,159

[45] Date of Patent: Jan. 30, 1990

[54] APPARATUS FOR PULP CONTAMINANT REMOVAL

[75] Inventors: Randall L. Bone, Pisgah Forest; Albert P. Kriek, Asheville; Eric D. Myracle; Don B. Rogers, both of Brevard, all of N.C.

[73] Assignee: P. H. Glatfelter Company, Spring Grove, Pa.

[21] Appl. No.: 165,001

[22] Filed: Mar. 7, 1988

[51] Int. Cl.[4] ..... D21F 7/00; D21G 9/00

[52] U.S. Cl. ..... 162/260; 162/263; 162/286; 83/177

[58] Field of Search ..... 162/255, 286, 195, 252, 162/49, 260, 263, 198; 83/177, 53

[56] References Cited

U.S. PATENT DOCUMENTS

| | | | |
|---|---|---|---|
| 2,667,106 | 1/1954 | Hyman et al. | 162/255 |
| 3,479,518 | 11/1969 | Akamatsu et al. | 250/219 |
| 3,551,678 | 12/1970 | Mitchell | 250/83.3 |
| 3,809,606 | 5/1974 | Stansbrey | 162/194 |
| 3,989,085 | 11/1976 | Crosby | 162/198 |
| 4,066,492 | 1/1978 | Hill | 162/49 |
| 4,092,068 | 5/1978 | Lucas et al. | 356/73 |
| 4,154,648 | 5/1979 | Osterberg et al. | 162/195 |
| 4,161,205 | 7/1979 | Justus | 162/133 |
| 4,182,170 | 1/1980 | Grupp | 83/177 |
| 4,402,604 | 9/1983 | Nash | 356/237 |
| 4,644,174 | 2/1987 | Ouellette et al. | 250/559 |
| 4,747,911 | 5/1988 | Pulson | 162/263 |

FOREIGN PATENT DOCUMENTS

| | | | |
|---|---|---|---|
| 1529165 | 6/1977 | Canada | 83/53 |

*Primary Examiner*—Steve Alvo

*Attorney, Agent, or Firm*—Kerkam, Stowell, Kondracki & Clarke

[57] ABSTRACT

Apparatus and method for automatically detecting and removing contaminant particles from a moving pulp mat are provided, detection of the particles being accomplished using a light source for transmitting light to the pulp mat, a light detecting means for detecting decreases in the intensity of light across the pulp mat corresponding to positions or locations of contaminant particles in the mat, and a control package for generating signals corresponding to the detected positions to be used in the contaminant removal proceses, removal of the particles being accomplished by cutting a rectangular section containing the particle from the mat using a bank of fluid jet nozzles which produce longitudinal slits and transverse cuts in the pulp mat as the mat travels past the nozzle bank. The removal section also has a catch trough disposed at the side of the mat opposite the nozzles for receiving the fluid sprayed from the nozzles through the mat and also for receiving the rectangular sections cut from the mat, the catch trough being further equipped with flush water and effluent pipe connections to facilitate disposal of the removed sections of the mat.

9 Claims, 3 Drawing Sheets

APPARATUS FOR PULP CONTAMINANT REMOVAL

BACKGROUND OF THE INVENTION

1. Field of the Invention

The present invention is directed to an automated method and apparatus for detecting and removing contaminant particles from a moving pulp mat in a paper making process.

2. Background of Related Art

In paper making processes, it is important to remove as many contaminants as possible from the pulp used to make the final paper products. Contaminants, such as metal, plastic, rubber or wood particles, which are not removed from the pulp will usually be chopped into smaller pieces in the subsequent refining processes. These smaller pieces eventually surface as prominent impurities in finished paper. Paper products having such impurities or imperfections are generally considered to be of inferior grade and in some instances the paper is rendered unsalable.

Contaminant removal has heretofore been performed generally as a manual operation. Human operators are stationed at an appropriate location adjacent the pulp processing equipment, typically at some point between the digesting and refining equipment, where the pulp is travelling in a wet mat form. The operators visually inspect the moving mat and manually pick the contaminant particles off of the mat surface as the mat travels past their inspection station.

The manual operation has several disadvantages which result in less than satisfactory removal. Particles embedded in the mat will generally pass by the inspection station undetected. Some smaller surface contaminants are also likely to pass by undetected, partially due to the size (about 6 feet in width) and travel speed (125 feet per minute) of the mat. Operator fatigue and inability to maintain concentration over a typical eight-hour shift further detract from the effectiveness of this method of contaminant removal. These factors combine to produce a larger than desirable quantity of contaminant particles entering the pulp mat refining equipment.

Various devices are known in the art for sensing defects, such as dirt or other inclusions, in a moving sheet of material. Some of these devices use a light sensing means to detect differences between normal, defect-free sections and sections containing defects. One such known apparatus further provides a means for marking the travelling sheet where the defect is detected, but generally none of the known devices provide further means for removing the defect from the travelling sheet.

Another device known in the art uses spray nozzles to create slits in a travelling paper mat to prevent the propagation of breaks detected in the paper mat, the breaks being detected by photocells. No provision is made in this apparatus for automatic removal of contaminant particles.

It is therefore an object of the present invention to provide an apparatus which is capable of automatically detecting the presence of contaminants in a pulp mat and automatically removing the contaminants detected from the pulp mat as the mat travels to a refining station, thereby obviating the need for manual inspection and removal stations.

It is a further object of the present invention to provide an apparatus capable of detecting contaminants disposed in the interior of the pulp mat in addition to detecting those on the surface.

It is a further object of the present invention to provide a pulp mat cutting means operatively coupled with a contaminant detecting means wherein a portion of the pulp mat containing the defect may be removed from the mat without stopping the travel of the mat.

Yet another object of the present invention is to provide a plurality of jet spray nozzles for cutting rectangular sections containing defects from the moving pulp mat and a catch trough for receiving and disposing of the sections cut from the pulp mat.

A further object of the present invention is to provide a method for detecting contaminants present in a moving pulp mat and for removing the detected contaminants using water spray cutters controlled by detection information.

SUMMARY OF THE INVENTION

The above and other objects of the present invention are accomplished in the present invention by providing a contaminant detection and removal system which uses a light source and an associated light detecting means which scans the moving pulp mat to detect variations, specifically decreases, in the intensity of light from the light source being transmitted through or reflected from the pulp mat. The light detecting means advantageously comprises a linear charge coupled device camera, whose output signal is sent to an electronics control package which interfaces with a pulp mat cutting and removal system.

The pulp mat cutter in the present invention comprises two sets or rows of water spray nozzles, one set of which is used to make longitudinal cuts in the travelling pulp mat, the other set being used to make transverse cuts in the mat. The output of the light detecting means is used to determine the location of a contaminant, generally associated with a decrease in light intensity, both in the longitudinal and transverse directions. The individual spray nozzles are controlled by a plurality of valves which are selectively opened and closed at the proper times, based on contaminant location information received from the control package, when the contaminant bearing section of the mat is moving past the spray nozzles. Longitudinal slits or cuts are made by jet water spray from two nozzles of the first set of nozzles along either side of the detected contaminant as the mat travels past these nozzles. A transverse cut spanning the distance between these longitudinal slits is made at or near a leading edge of the slits by a jet water spray from one of the second set of nozzles, each nozzle of the second set of nozzles being adapted and disposed to make a cut spanning the distance between two of the longitudinal cuts. A continued spray from the nozzle of the second set will cause a rectangular section to sever from the mat near the trailing end of the longitudinal slits. The selection and activation of the appropriate valve and transverse cutting nozzle is also accomplished by using the contaminant location information.

A catch trough advantageously spans the width of the moving pulp mt at the side of the mat opposite the sets of water spray nozzles. The catch trough has passages disposed to receive the water as it cuts through the pulp mat and also to receive the rectangular sections separated from the mat by the water jet streams. The used water and the removed pulp mat sections may then be flushed out of the trough into a disposal system.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention, taken in conjunction with the accompanying drawings wherein like reference characters represent like parts throughout the several views and wherein.

DETAILED DESCRIPTION OF THE INVENTION

Figure 1:
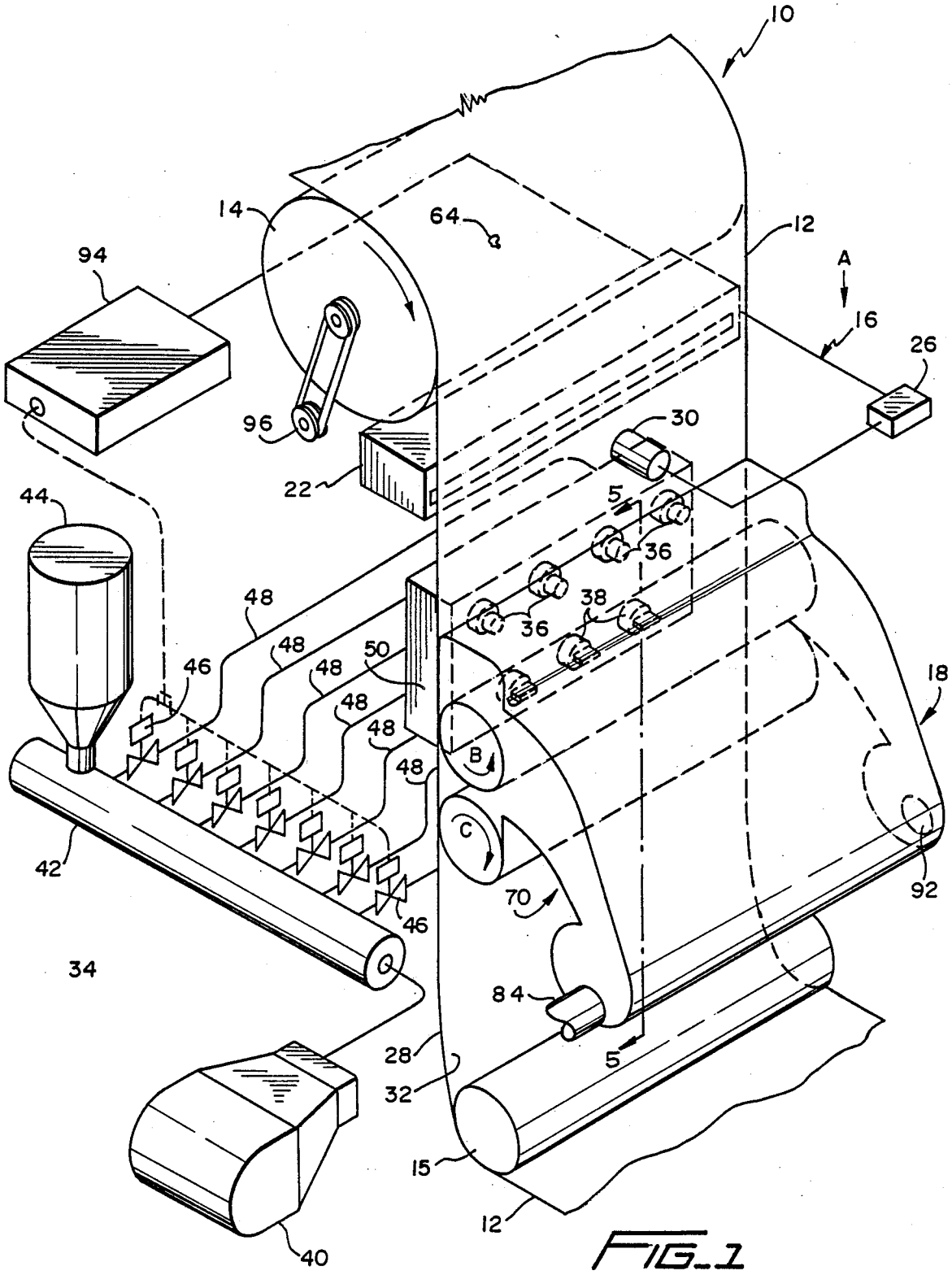
FIG. 1 is a perspective view of the pulp contaminant removal apparatus of the present invention, with the valves and valve controller shown in a schematic representation.

Referring initially to FIG. 1, the apparatus for detecting and removing contaminants from a pulp mat is indicated generally by numeral 10. The apparatus 10 is located with respect to the overall paper making process at a point after an initial digesting step and before a refining step, where after the pulp is formed into a finished paper product. The equipment which performs the digesting and refining steps is not shown and forms no specific part of the present invention, except to the extent that the apparatus 10 of the present invention can be adapted for use with existing, known paper making equipment. A bleaching operation is also performed between the digesting and refining steps, and the apparatus and method of the present invention, which involves the detection and removal of contaminants, may be employed either before or after this bleaching operation.

The pulp to be processed into finished paper products leaves the digesting equipment and exits from a flax pulp wash station (not shown) in the form of a wet pulp mat 12 advanced by drum 14. The dimensions of a pulp mat 12 in a paper making process according to the present invention are, typically, six feet in width, ¼ to ½ inch in thickness, and of essentially indefinite, continuous length. The pulp mat 12 travels or advances in what will be termed a "direction of mat travel" indicated by arrow A. The mat will typically move at speeds on the order of 120–125 feet per minute.

In the preferred embodiment of the apparatus 10, pulp mat 12 is advanced at the above-mentioned speed range over drum 14 by conventional means. Drum 14 itself is preferably equipped to be a drive roller by providing a suitable known power means such as an electric motor (not shown) to rotate the drum. Alternatively, a roller 15 may be provided in the apparatus and may serve as a drive roller.

After passing over drum 14, pulp mat 12 travels through the detection and removal sections of the present invention along direction of mat travel, which alternatively may be termed the longitudinal or vertical direction.

The pulp mat 12 moves through a contaminant detection section 16 and subsequently through a contaminant removal section 18, the two sections being in communication with each other via suitable interfaces incorporated into electronic components of each section.

Detection section 16 comprises a light source 22, a light detecting means generally designated as 30, and a control package 26 for the light detecting means. Light source 22 is disposed adjacent to a first surface 28 of pulp mat 12 and positioned to transmit light therethrough. The light source 22 and light detecting means 30 may be selected from commercially available equipment used in web inspection devices, and are therefore shown essentially in schematic form. Any necessary adaptations or modifications to these components for performance of the functions in the present invention will be readily apparent to those skilled in the art.

The light source 22 selected for use should be capable of transmitting either infrared (IR) or visible light through pulp mat 12 across the entire width of the mat. Light source 22 is preferably of a narrow, elongated shape, as depicted, such that the light is transmitted through the entire width, but only through a small portion of the length of the mat 12 at a given instant.

Light detecting means 30, preferably comprising a linear charge-coupled device (LCCD) type camera is disposed, in the FIG. 1 embodiment, adjacent to the second surface 32 of the pulp mat, opposite the light source 22 at a position and distance where it is able to scan and detect transmitted light (either visible or IR) across the entire width of the mat 12.

Figure 2:
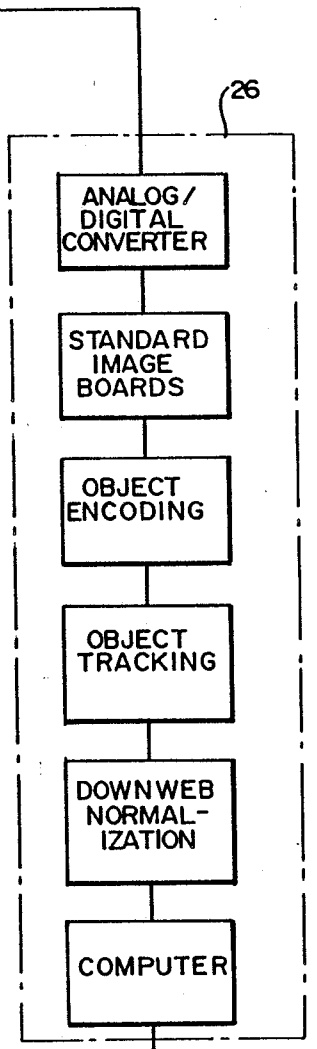
FIG. 2 is a perspective view of the detection section of the apparatus of the present invention, showing an alternate positioning of the light detecting camera and block diagram representation of the Control package.
Figure 2:
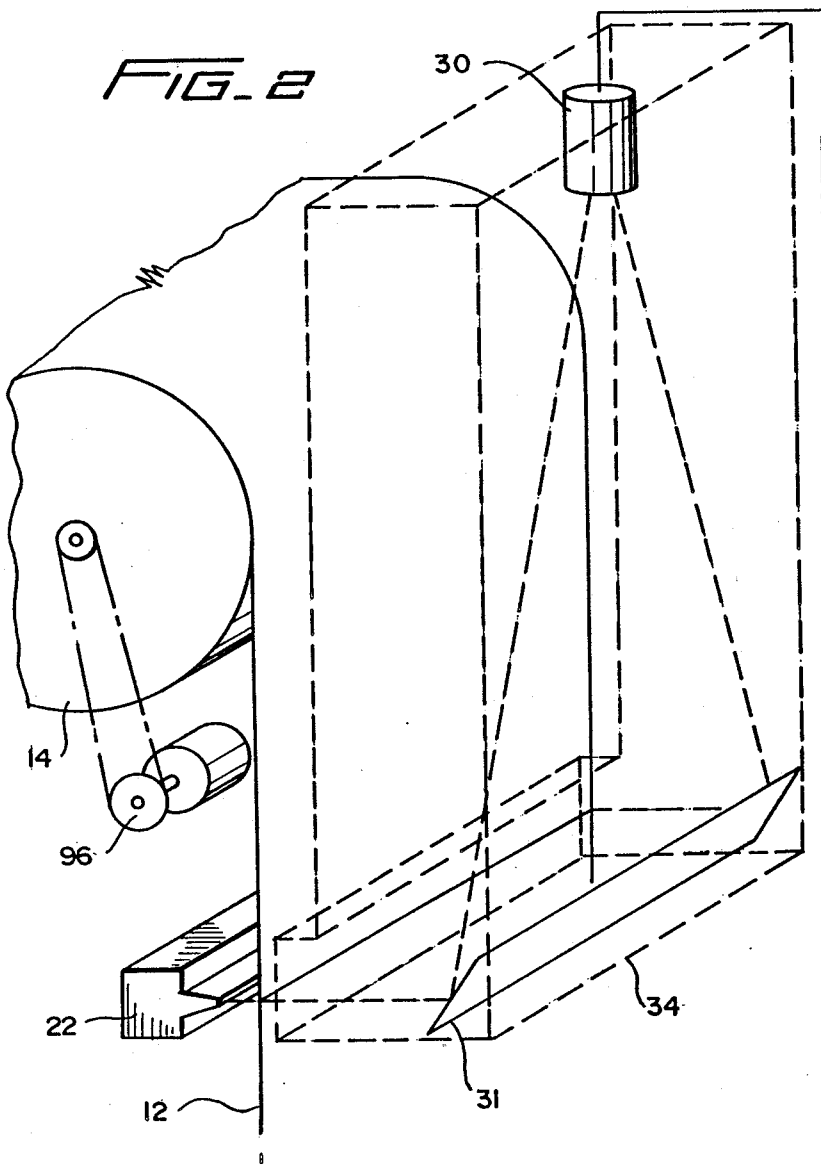

FIG. 2 depicts an alternative preferred position for LCCD camera 30, used in conjunction with reflector or mirror 31. This embodiment is preferred where there is insufficient space to mount a camera 30 directly opposite the light source 22. It is to be recognized that the camera 30 may be mounted in various other positions, using reflectors to direct an image of the transmitted light, within the scope of the present invention.

Typical or commonly encountered contaminant particles such as strings, ropes, wires, or other irregularly shaped solids such as flakes or sheets, made of metal, plastic, rubber, wood or the like, will generally be opaque to light in the visible and IR light wavelengths. By comparison, a pulp mat having a thickness on the order of ½ inch is essentially transparent to light, especially light in the near-infrared range. Thus, camera 30 will be able to instantaneously detect a decrease in light intensity when such a contaminant particle passes between the light source 22 and the camera 30. Linear-charge coupled device cameras 30 suitable to be adapted for use in the present invention will generate essentially continuous and instantaneous output signals corresponding to the intensity of light detected across the width of the pulp mat 12. Such cameras are known in the art and are commercially available, for example, from manufacturers of web inspection devices.

The camera 30 to be selected should provide relatively small detection increments in the transverse (mat width) direction. To this end, a camera having 2,048 pixels, or discrete imaging increments, an example of which is available from Integrated Automation of Alameda, Calif., may advantageously be used with paper making equipment which processes a pulp mat 12 having a 72-inch width. The camera 30 is preferably positioned and oriented such that the pixels will provide a image covering nearly exactly the 72-inch width of the mat 12, each pixel thereby representing an transverse increment on the mat of 0.035 inch.

The control package 26 operates in the detection section 16 to convert information generated by the camera 30, relating to the detection of decreases in light intensity corresponding to contaminants passing between the light source 22 and the camera 30, into signals which can be used by the removal section 18 to remove the contaminants from the mat. The control package 26, shown as a black box in FIG. 1, may be assembled using standard, commercially available components which would typically include, as can be seen in the schematic representation in FIG. 2, an analog/digital converter, standard image boards, and a computer which performs various processing steps such as object encoding, tracking, and normalization.

The control package 26 will advantageously be capable of processing ten million pixels per second when used in combination with the above-mentioned LCCD camera 30 having 2,048 pixels. This will allow the control package 26 to make up to 4883 scans per second of the array of 2,048 pixels. Where such equipment is used in a paper making process in which the mat travels past the camera 30 at a velocity of 24 inches per second (120 feet per minute), it will be recognized that a scan interval of 0.0049 inches per scan in the longitudinal direction of mat travel may be attained. The use of camera and signal processing equipment providing transverse detection increments and longitudinal scan intervals on the order of those described above will ensure that adequate detection coverage of the moving pulp mat 12 is obtained. LCCD cameras with other numbers of pixels, for example 1024 or 4096, can be used to obtain other scan widths or scan intervals to suit particular applications.

It has been determined in the development of the contaminant particle removal system of the present invention that the detector section 16 discussed above is generally capable of detecting, in a typical 178 inch mat, particles as small as about 3/16 inch in diameter in size on or near the surface 28 of the pulp mat 12 nearest the light source 22. The detector section 16 has also been determined to be capable of detecting particles as small as about 1/16 inch in diameter on or near the surface 32 of pulp mat 12 opposite surface 28. The difference in particle size detection is primarily due to a diffusion of the transmitted light by the pulp fibers, which causes light passing around a contaminant particle to converge before reaching camera 30. The average size of detectable particles in a ½-inch thick pulp mat 12 may therefore be considered as being on the order of ⅛ inch. The word "diameter" is used herein as a term to describe an approximate dimension, and "width" or "length" could be substituted when describing non-circular and non-spherical particles.

The apparatus 10 may be provided with means for detecting reflected light in combination with or instead of means for detecting transmitted light, where increased detection accuracy and efficiency are desired. A system for detection of reflected light would employ a light detecting means similar, if not identical, to camera 30 positioned on the same side of the pulp mat 12 as light source 22 (position not shown). As a further measure in improving the efficiency and accuracy of the detection section 16, the light path between the light source 22 and light detecting means 30 may be substantially entirely enclosed by a shroud or duct 34, shown schematically in phantom lines in of FIG. 2. The duct 34 is provided to prevent any inadvertent interference with the light being transmitted and detected.

The detection section 16 communicates with, and is linked by way of control package 26 to, the contaminant removal section 18. Removal section 18 is designed to, upon commands received from control package 26, cut and remove rectangular sections 100 (FIG. 3) from the travelling pulp mat 12 where contaminants have been detected, the cutting being performed by high-pressure fluid, preferably water, streams or jets directed against the pulp mat 12 by a first and second row of nozzles 36, 38, respectively.

The water to be sprayed by nozzles 36, 38 is provided from a pump 40 and distribution manifold 42 arrangement, which also preferably includes a pressure accumulator 44. The use of a pressure accumulator 44 ensures that adequate water pressure will be available even under sudden heavy demands by this system. The manifold 42 provides pressurized water to nozzles 36, 38 through individually operated solenoid valves, shown schematically and identified collectively by numeral 46. Individual piping runs 48 connect each solenoid valve 46 with an associated spray nozzle. Thus, the fluid discharge from each of the nozzles may be individually controlled.

The components of this fluid supply means, i.e., the pump 40, manifold 42, pressure accumulator 44, valves 46, and piping 48 may be selected from commercially available items having suitable flow capacities and pressure ratings. It should also be readily apparent that the components, especially the pump 40, may be provided in a quantity other than that depicted in the preferred embodiment, where the required water delivery capacity exceeds the capacity of a particular commercially available component.

The first and second sets of nozzles or cutters 36, 38 are positioned downstream of the detection section 16 such that the pulp mat 12 will travel first through the detection section before travelling past the rows of nozzles 36, 38. The rows of nozzles are arranged or arrayed on a nozzle bank 50 such that each nozzle opening faces first surface 28 of pulp mat 12, and each nozzle is disposed in a substantially perpendicular orientation to surface 28, best seen in FIGS. 4, 5. The nozzle bank 50 fixes the rows of nozzles 36, 38 in an array which is designed to be capable of cutting small tongue-like sections 102 in the travelling pulp mat 12. To this end, the first row of nozzles 36 is used to make spaced longitudinal slits or cuts 52, 54 (FIG. 3) in the pulp mat, and the second set of nozzles 38 is used to make transverse cuts 56 in the mat in the space between the longitudinal slits.

Figure 5:
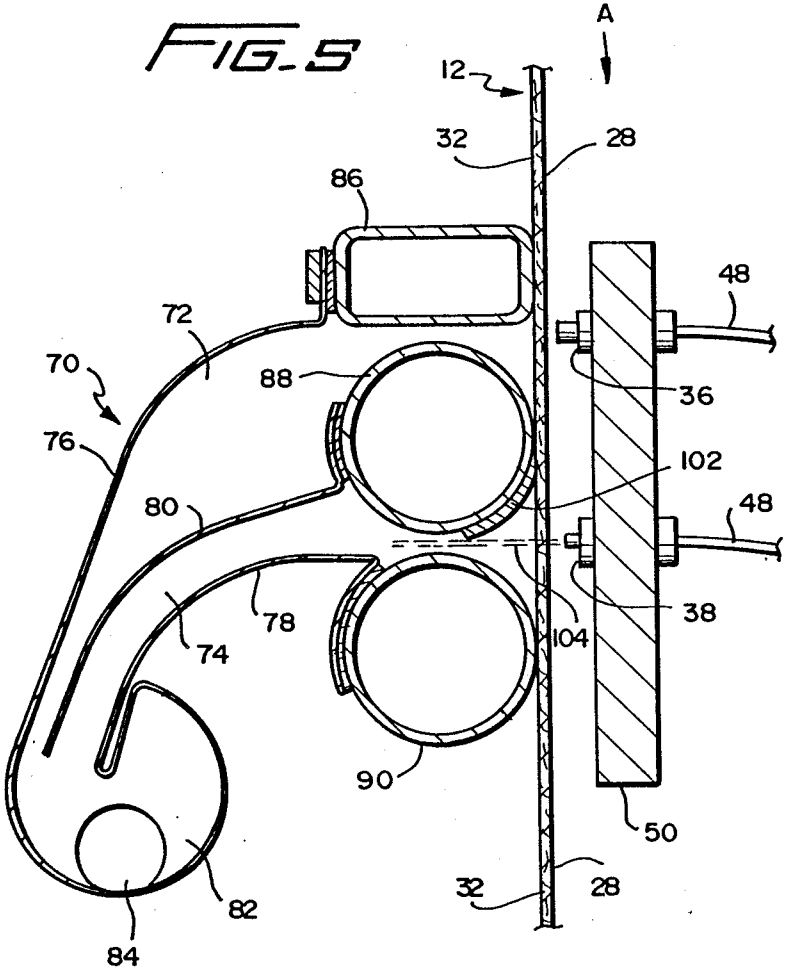
FIG. 5 is a cross section of the catch trough and nozzle array taken along line 5—5 of FIG. 1.
Figure 4:
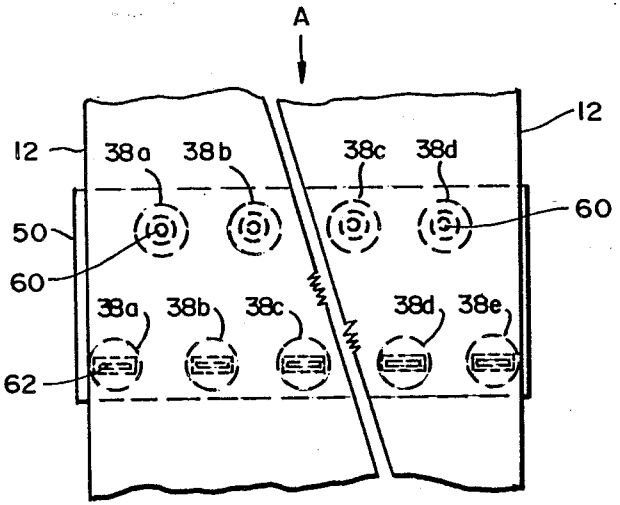
FIG. 4 is a partial elevation view showing the nozzle array in relation to the pulp mat.

As best shown in FIG. 4, the nozzles 36 *a,b,c,d*, comprising first row of nozzles 36 preferably have small diameter circular orifices 60 which will discharge solid, small diameter cylindrical streams. These nozzles 36 *a,b,c,d* are preferably spaced along a straight line spanning substantially the entire width of pulp mat 12. The nozzles 36 *a,b,c,d* are themselves stationary, and the parallel, longitudinal slits will be made by the jet fluid streams discharged from the nozzles as the pulp mat 12 moves relative to and downwardly past the nozzles in direction A. The second row of nozzles 38 is preferably disposed downstream of, but in close proximity to the first row of nozzles 36, and preferably on the same nozzle bank 50 as first row 36. Each of the nozzles 38 *a,b,c,d,e* of the second row 38 will preferably have a slot-like orifice 62 designed to discharge a flat spray oriented transverse to the direction of mat travel A, or horizontally as seen in FIGS. 4, 5. The spray from these orifices 62 will preferably diverge slightly in the transverse sense. These nozzles 38 *a,b,c,d,e* are preferably disposed along a straight line parallel to that containing nozzles 36 *a, b, c, d*, and are preferably disposed along imaginary vertical center lines which bisect the spaces between adjacent nozzles of the first set of nozzles 36. Nozzles 38 *a, b, c, d, e*, are also stationary, and when discharged, the fluid stream will pierce the pulp mat 12 to make transverse cuts extending between the two longitudinal cuts previously made by two nozzles of the first set 36.

As can be seen in FIGS. 1 and 5, the removal section 18 of the present invention is also preferably provided with a catch trough 70 which is disposed at the side of mat 12 opposite nozzle bank 50, and extends across the entire width of the mat (FIG. 1) to perform several functions in the contaminant removal process. The trough 70 is provided with an upper passage 72 and a lower passage 74 bounded by curved outer walls 76, 78, and separated by divider wall 80. The trough 70 is provided with a scroll section 82 at its bottom and a drain pipe or effluent passage 84 extending out from one side at the base of scroll 82. Positioned directly in contact with pulp mat 12 are first, second, and third facing members 86, 88, and 90 respectively. These facing members 86, 88, 90 are secured to the upper ends of walls 76, 80, and 78 respectively. Catch trough 70 is also preferably provided with a flush water connection 92 (FIG. 1) at the side opposite effluent passage 84.

Referring more particularly now to FIG. 5, catch trough 70 can be seen in the preferred position in relation to nozzle bank 50 and first and second rows of nozzles 36, 38. The facing members 86, 88, 90, are positioned such that they will be in sliding contact with travelling pulp mat 12, and the members will therefore preferably be clad with a low-friction material, such as shrink tubing made of Teflon (not shown). First facing member 86 is preferably rectangular, with rounded corners, in cross section, and second and third facing members 88, 90 are preferably circular in cross section.

First, second, and third facing members 86, 88, 90 are spaced apart vertically from each other, and the spaces or slots between first and second facing members 86, 88 and between second and third facing members 88, 90 preferably are aligned with and directly oppose the location of nozzles 36, 38, as shown. Positioned in this manner, the facing members will provide support for the mat 12 when water jets are cutting through the mat and, at the same time, the slots allow the water used in cutting to enter the upper and lower passages 72, 74, to be thereafter disposed of. Catch trough 70 will also function as the receptacle for the rectangular sections 100 which are cut from the travelling mat 12.

Tongue 102 is urged into lower passage 74 by the drag of the spray 104 from nozzle 38 which makes transverse cut 56 in the mat, as seen in FIG. 5. The tongue 102 is subsequently pulled completely away from mat 12 by the drag imposed by the continued spray 104 from nozzle 38, which causes a transverse separation 58 (see FIG. 3) near the trailing ends of longitudinal slits 52, 54, creating rectangular section 100. The drag from the continued spray of pressurized water carries section 100 completely into lower passage 74, and subsequently into scroll 82 of catch trough 70.

The flow reversal and baffling provided by scroll 82 is designed to substantially prevent any backsplashing of the removed section 100 onto mat 12, thereby preventing recontamination of the mat by the removed contaminant particles. Scroll 82 may be intermittently flushed clean by introducing flush water through connection 92, forcing the removed pulp sections out of scroll 82 through effluent passage 84. Scroll 82 may advantageously be pitched or tilted toward the side having effluent passage 84 extending therefrom.

A slight variation on the depicted preferred embodiment of catch trough 70 is also envisioned. As indicated schematically by directional arrows B and C in FIG. 1, means for rotating second and third facing members 88, 90 may be provided. The use of rotating members will create a nip action in the space between the rollers which can assist in pulling the tongue 102 to separate it from mat 12.

Figure 3:
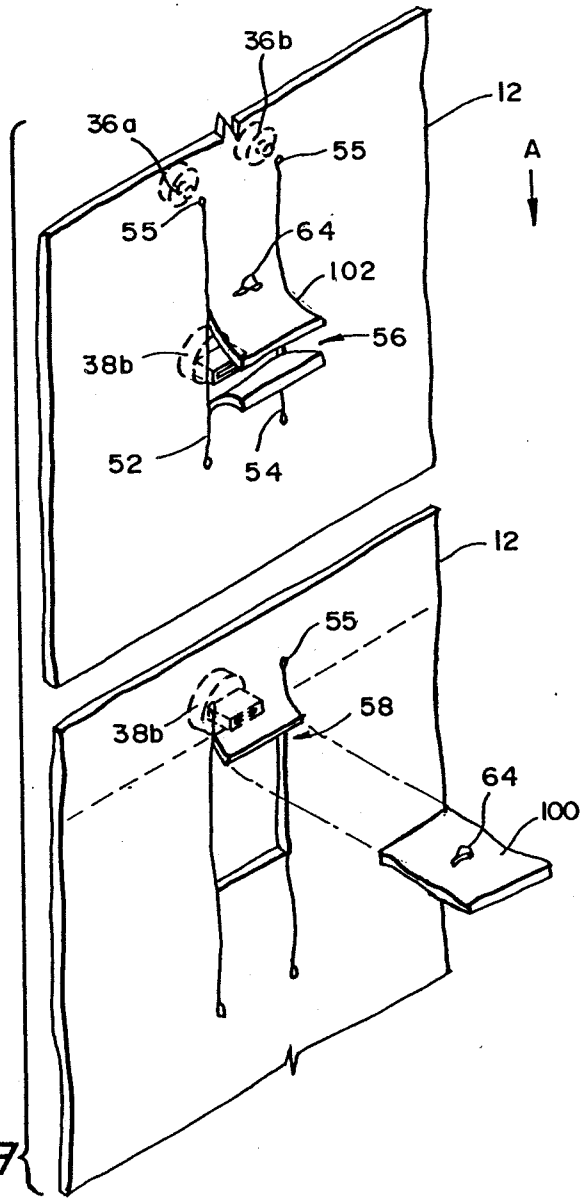
FIG. 3 is a fragmentary perspective view of a section of a pulp mat being cut from the mat.

The interaction of the detector section 16 and removal section 18 will now be discussed with reference primarily to FIGS. 1 and 3. As a contaminant particle 64 contained in moving pulp mat 12 passes between light source 22 and camera 30, the pixels in the camera which are positioned to detect light intensity in that particular portion of the pulp mat 12 will indicate an instantaneous decrease in the light intensity detected when scanned by control package 26. Control package 26 interprets the images from the camera 30 and transmits a signal corresponding to the location of the detected contaminant to a removal system controller 94. Removal system controller 94 also shown schematically, is provided with suitable interfaces for receiving signals from control package 26 and for transmitting signals to the solenoid valves 46 for their operation. Removal system controller 94 uses contaminant position information obtained from control package 26 to produce signals to selectively actuate the appropriate solenoid valves 46 to supply pressurized water (or other fluid) to the nozzles associated with those valves for cutting the mat.

The control package 26 of the detector section 16 is designed to provide information fixing both the transverse position and the longitudinal position of the contaminant particle 64 at the time the particle is detected. The transverse position will not change as the pulp mat 12 advances to the removal section 18, and therefore the removal section controller may use that information directly to select the two nozzles, for example 36 *a, b* in FIG. 3, of the first set of nozzles 36 which are disposed immediately adjacent to that transverse position and the nozzle 38*b* of the second set of nozzles 38 disposed below and between nozzles 36 *a, b*. The travel velocity of the mat must also be computed, however, in order for the removal section controller 94 to properly time the opening and closing of the selected valves in order to ensure that a section containing particle 64 is removed and to minimize the amount of uncontaminated pulp removed with the contaminant particle.

For a particular given installation, the distance between the light detecting means 24 and the first and second set of nozzles 36, 38, as measured in the direction of mat travel A, will be fixed. The mat travel velocity is preferably computed by way of a signal proportional to the velocity generated by a tachometer 96 driven by the drum 14 which is transporting the mat 12. This signal is transmitted to control package 26 and then relayed in the form of a command to removal section controller 94, or may be transmitted to removal section controller 94 directly. Using the mat velocity and the fixed distance, the time it takes for the portion of the mat containing the particle to travel from the detection section to the removal section is determined, and the solenoid valves are actuated accordingly.

Contaminant particles are removed in the removal section by first activating (opening) the two solenoid valves 46 which control the fluid flow to the two nozzles 36 *a, b,* of the first row of nozzles immediately adjacent, i.e. on either side in a transverse sense, to a detected particle 64. As can be seen in FIG. 3, the valves are preferably opened, via signals from controller 94, for a sufficient period of time to allow the fluid streams to make longitudinal slits 52, 54 beginning upstream of, and ending downstream of, the location of detected particle 64. Removal section controller 94 will then preferably open the valve 46 associated with nozzle 38*b* to make transverse cut 56 at a location slightly preceding the particle location. Controller 94 is preferably designed to maintain the valve 46 controlling nozzle 38*b* in an open position such that nozzle 38*b* will continue to discharge a stream of fluid as mat 12 continues to travel in direction A. The fluid pressure, or drag, of the continued spray will cause tongue 102 to begin to pull away from (see FIG. 5) and ultimately break away from mat 12 at a generally transverse break 58 near the respective trailing ends 55 of longitudinal slits 52, 54. The valve 46 associated with nozzle 38*b* is then preferably closed by controller 94 at a time immediately before the trailing ends 55 of longitudinal slits 52, 54 pass by the nozzle.

Thus, it can be seen that a relatively small rectangular section 100 containing a contaminant particle 64 may be removed from the pulp mat without interfering with or halting the mat travel. A preferred spacing between the nozzles of the first row of nozzles 36 is approximately two inches, which permits vertical or longitudinal slits 52, 54 to be made at two inch intervals across the width of the mat. Thus, the nozzles 36 will cut a section 100 containing a contaminant particle resulting in the removal of only a two-inch wide piece from a 72-inch wide mat.

It will be readily apparent that in order to provide a set of nozzles 36 at a two-inch spacing across the width of a 72-inch wide mat, that at least thirty-five nozzles would be required. Referring to FIG. 4, the diagonal break 104 is intended to show that the nozzle bank 50 has an indefinite span, which can be sized in accordance with the width of the mat 12 processed in the paper making equipment. Additionally, it should be readily apparent that a plurality of nozzle banks may be positioned in a substantially side-by-side manner, each of the banks being connected to separate water supply equipment systems.

It can be seen in FIG. 4 that, at either edge of mat 12, nozzles 36 are spaced inwardly from the edge. Full width coverage of the mat is still provided, however, because only one longitudinal slit need be cut in the mat, as the edge of the mat will serve as a second "slit". The outward nozzles of the second set of nozzles 38, 38*a* for example, will be positioned to make a transverse cut in the mat extending from the edge of the mat to a point which will intersect a longitudinal slit made by nozzle 36*a*.

The present invention also embodies a method for detecting and removing contaminant particles from a moving pulp mat. This method involves transmitting light using light source 22 through the pulp mat 12 and detecting the intensity of the transmitted light with camera 30. A further step in the detection process is to generate a signal or signals corresponding to longitudinal and transverse locations on the moving mat where decreases in light intensity are detected, the decreases being indicative of the location of contaminant particles, by means of a control package 26.

The method further comprises removing the portion of the mat containing the contaminant particle, i.e., where decreased light intensity is detected, from the moving mat. The removal process involves spraying or discharging streams of fluid at the mat 12 from two nozzles of a first row of nozzles 36 disposed on either side of the transverse position where the decreased light has been detected, thereby cutting through the mat and creating longitudinal slits or cuts of predetermined length on both sides of the particle. The method also involves timing the spray from the two nozzles such that the slits created extend in front of (preceding) and behind (trailing) the longitudinal position of the detected particle. A further step entails spraying a flat, transversely oriented jet stream of fluid to produce a transverse cut in the pulp mat 12, from a nozzle in a second row of nozzles, the transverse cut being made between and intersecting the two longitudinal slits, and preceding the location of the particle. The method concludes with continuing the transversely oriented spray as the mat 12 continues to travel, the drag of the spray thereby inducing a transverse separation extending between and near a trailing end of the longitudinal slits, completely separating a section 100 from the mat 12 containing the detected contaminant particle 64.

The foregoing description includes various details and particular structures according to the preferred embodiment of the invention, however, it is to be understood that these are for illustrative purposes only. Various modifications and adaptations will become apparent to those skilled in the art. Accordingly, the scope of the present invention is to be determined by reference to the appended claims.

What is claimed is:

1. Apparatus for removing contaminant particles from a moving pulp mat comprising:

a detection section having a light source adapted to transmit light to an entire width of said moving pulp mat, means for detecting an intensity of light across said entire width of the mat, and means for generating signals corresponding to positions on said mat where decreases are detected in said light intensity by said detecting means, said detected decreases corresponding to locations of contaminant particles in said moving pulp mat;

a removal section further comprising:

a plurality of nozzle spray means for discharging pressurized streams of fluid to cut sections from said mat, said spray means being adapted to produce substantially longitudinal slits as said pulp mat moves past said spray means and to produce substantially transverse cuts intersecting said longitudinal slits;

means for supplying pressurized fluid to said nozzle spray means;

control means for selectively discharging pressurized fluid from said spray means responsive to signals received from said signal generating means to produce longitudinal slits and transverse cuts in said pulp mat sufficient to separate sections from said mat corresponding to positions where said decreases in light intensity have been detected by said detecting means; and wherein said nozzle spray means further comprises a first row and a second row of nozzles, each nozzle of said first row having a small diameter circular orifice facing said pulp mat and being positioned to dispense a stream of pressurized fluid for producing a longitudinal slit in said pulp mat as said mat moves past said first row, each nozzle of said second row having an elongated, transversely oriented slot orifice facing said pulp mat and being positioned to dispense a stream of pressurized fluid for producing a horizontal cut in said pulp mat, each nozzle of said second row further being stationary and associated with a pair of adjacent nozzles of said first row and positioned and sized to produce a horizontal cut intersecting longitudinal slits produced by said associated pair of nozzles of said first row.

2. An apparatus as defined in claim 1 wherein said removal section further comprises a plurality of solenoid operated valves, a total number of said valves being equal to a total number of nozzles in said first row and said second row of nozzles, each nozzle having an associated one of said valves operatively connected thereto, each of said associated valves controlling the discharge of fluid from the nozzle associated therewith.

3. An apparatus as defined in claim 2 wherein said control means further comprises means for selectively opening said solenoid valves responsive to said signals received from said signal generating means to discharge pressurized fluid from said nozzles associated with said opened valves and means for supplying pressurized fluid to said nozzles.

4. An apparatus as defined in claim 3 wherein said pulp mat is oriented to move in a vertical direction initially past said detection section and subsequently past said removal section, said first and said second rows of nozzles being disposed to dispense the pressurized fluid toward said pulp mat in a substantially horizontal direction.

5. An apparatus as defined in claim 4, further comprising a catch trough, said trough being disposed on a side of said pulp mat opposite that of said first and second rows of nozzles, said trough having means for receiving said fluid dispensed from said first and second rows of nozzles, said receiving means further being adapted to receive said separated sections of said pulp mat.

6. An apparatus as defined in claim 5, wherein said trough further comprises a plurality of facing members disposed in sliding contact with a surface of said moving pulp mat, and wherein said facing members provide support for said mat when said pressurized fluid is dispensed from said nozzles to cut said pulp mat.

7. An apparatus as defined in claim 6 wherein said first row of nozzles is disposed at position vertically above said second row of nozzles, and said receiving means of said trough comprises an upper and a lower passage separated by a divider wall, and wherein said upper passage is disposed to receive pressurized fluid discharged from said first row of nozzles and said lower passage is disposed to receive pressurized fluid discharged from said second row of nozzles.

8. An apparatus as defined in claim 7 wherein said upper and lower passages curve downwardly and away from said mat and said passages open into a scroll section at a bottom of said trough.

9. An apparatus as defined in claim 7 wherein said divider wall has one of said plurality of facing members attached thereto, said facing member being circular in cross-sectional shape, and wherein said sections being separated from said moving pulp mat are guided into said lower passage by said facing member and by said pressurized fluid discharge of said second row of nozzles.

* * * * *